United States Patent [19]

Stenlund

[11] Patent Number: 4,923,003

[45] Date of Patent: May 8, 1990

[54] HEAT EXCHANGER

[75] Inventor: Stig G. Stenlund, Saltsjöbaden, Sweden

[73] Assignee: Hypeco AB, Malmo, Sweden

[21] Appl. No.: 847,659

[22] PCT Filed: Jun. 28, 1984

[86] PCT No.: PCT/SE84/00245

§ 371 Date: Feb. 25, 1986

§ 102(e) Date: Feb. 25, 1986

[87] PCT Pub. No.: WO86/00395

PCT Pub. Date: Jan. 16, 1986

[51] Int. Cl.[5] ..... F28F 13/02; F28F 1/10

[52] U.S. Cl. ..... 165/165; 165/154; 165/70; 165/903; 165/167

[58] Field of Search ..... 165/165, 164, 1541903

[56] References Cited

U.S. PATENT DOCUMENTS 4,368,779 1/1983 Rojey et al. ..... 165/165
4,445,569 5/1984 Sabol et al. ..... 165/165

FOREIGN PATENT DOCUMENTS 177609 7/1953 Austria ..... 165/154

*Primary Examiner*—Albert W. Davis, Jr.

*Attorney, Agent, or Firm*—Browdy & Neimark

[57] ABSTRACT

A heat exchanger for the exchange of heat between two media (Ma, Mb), each of which flows through a respective one of two chambers (A, B) mutually separated by a medium-impervious partition wall (5) made of thermal conductive material. The interior of each of the flow chambers, or at least of one flow chamber, is divided into a large number of medium-flow passages, which are connected in parallel with respect to the flow of medium passing therethrough. The flow passages (13, and 17) have a substantially rectangular cross-section having a flow area which is so adapted in respect of the medium flowing therethrough that the flow in the passages is substantially laminar throughout the whole length of the passages, without a central turbulent zone. The passage walls defining the flow passages comprise a highly thermal-conductive material and are formed integrally with, or in good heat-conducting contact with the partition wall (5) located between the two flow chambers (A, B). The width (s) of the flow passages parallel with the partition wall is at most 1.5 mm and preferably less than 1.00 mm. The height (h) of the flow passages, and therewith the passage walls, at right angles to the partition wall is normally less than 8 mm and often 2–5 mm, while the thickness of the passage walls is normally less than 1 mm.

19 Claims, 9 Drawing Sheets

HEAT EXCHANGER

Figure 1A:
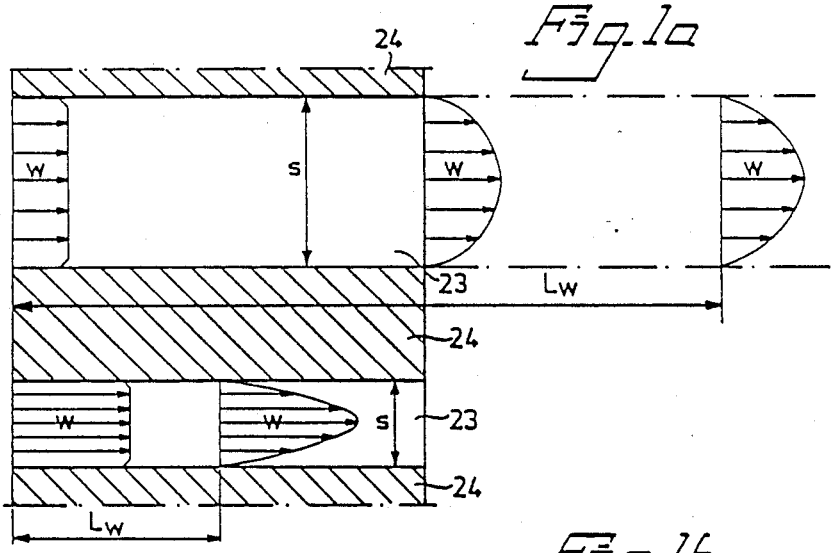

When, in the case of a heat exchanger, it is desired to achieve a high heat exchange per unit of volume, there are essentially three factors which are of importance, assuming that the nature of the two heat-exchange media involved, the volumetric flows thereof, and their input temperatures are known factors. The factors primarily affecting the exchange of heat in a heat exchanger are firstly the effective area of the medium contacting surfaces of the thermally conductive partition walls separating the two media; secondly the length of the paths along which the heat must be conducted within respective media, towards and away from said partition walls, and within said walls; and those percentages of the total temperature difference which lie along said path-lengths.

Conventional tube heat-exchangers or plate heat-exchangers, which completely dominate present day markets, operate with a turbulent flow of the heat-exchange media. Thus, in the passage, channel or like duct through which a medium flows there is found a central zone of turbulent flow within which the temperature is relatively constant and uniform over the whole cross-section of the zone, while adjacent the defining walls of said flow passage, these walls also forming partition walls which mutually separate the two heat-exchange media, there are found thin boundary layers of substantially laminar flow. Since the thermal conductivity of the material in the walls of the flow passage is much greater than that of the medium and the temperature difference within the central turbulent zone is low, the major part of the total temperature difference will occur over the laminar boundary layer. Consequently, the majority of those steps taken in turbulent-flow heat exchangers to increase the heat-exchange efficiency thereof are concentrated on maintaining a thin laminar-flow boundary layer and the assurance of good turbulence in said central zone. To this end, various kinds of "flow interrupters" are arranged in the flow passages Conventional tube and plate type heat exchangers functioning in accordance with the aforementioned turbulent flow principle are encumbered with a number of serious disadvantages. Since the central turbulent zone in the flow passages takes up a large part of the total volume, that area of the heat-transferring partition wall which comes into contact with the heat-exchange media is relatively small, when calculated per unit of volume. When viewed from a purely theoretical aspect, it is possible to provide a larger contact surface area between the two heat-exchange media and the walls separating said media, by miniaturizing the flow passages, irrespective of whether these passages are formed by tubes of circular cross-section or some other cross-section, or are formed by the voids between mutually opposing planar plates. The extent to which such miniturization need be carried out in order to be really effective, however, leads to unacceptable pressure drops, and also presents significant disadvantages in the form of manufacturing problems and high manufacturing costs. In addition, existing problems of providing an effective seal between the two media, already of a serious nature, are worsened. Present day tube and plate type heat exchangers are highly susceptible to corrosion and are unable to withstand pressure to any great extent, due to the relatively thin walls between the heat-exchange media. Additional hereto, such heat exchangers have a large number of locations which require sealing, thereby creating risk of leakage between the media. These fundamental weaknesses have normally lead to the use of stainless steel and readily brazed or soldered, non-corroding copper alloys, while the use of aluminium alloys has generally been ignored, despite that the bulk price of aluminium alloys is lower than that of copper alloys.

Practical designs of heat exchangers of the kind in which the heat-exchange media have a laminar flow across the whole cross-section of the flow passages, i.e. with no central turbulent zone, are little known on present day markets, and only a few such heat exchangers are to be found described in the patent literature. In this type of "laminar"-flow or "viscous"-flow heat exchanger, to which category the heat exchanger according to the present invention belongs, an attempt is made to provide heat-exchange media flow channels or passages of such cross-sectional dimensions that the flow of medium through said passages is substantially laminar over the whole cross-section thereof. In this case, the transfer of heat between the flowing medium and the passage walls takes place respectively from or towards each point in the flow passage, generally without the aid of mixing between zones of mutually different temperatures. It will be understood that by radically decreasing the cross-sectional dimensions of the flow passages in the direction in which heat is conducted, i.e. at right angles to the heat-transferring walls of the passages, it is possible to achieve both short heat-conducting paths and a large contact surface area between the medium and the passage walls, which should in turn result in good heat transfer and a good heat-exchange effect. Flow passages which have very small cross-sectional dimensions, however, normally create serious problems, inter alia such as:.

(1) the pressure drop is high and greatly dependent upon viscosity. The pressure drop is also drastically increased when the cross-sectional dimensions of the passages become still smaller, as a result of deposits forming therein. The formation of such deposits can ultimately result in total blockage of the passages.

(2) Because of their small dimensions, the passages are difficult to clean, and the nature of the flowing medium may be such as to require the passages to be cleaned frequently, so as to prevent blockages occurring.

(3) It can be both difficult and expensive to manufacture flow passages of very small dimensions with the precision required Flow passages which have very small cross-sectional dimensions and in which the medium has a laminar flow, however, lead to other problems which are of a more principal nature and which cannot be perceived so readily. For example, when attempting to provide a large contact surface area between the media and the passage walls while, at the same time, attempting to reduce as far as possible the number of sealing locations between the two media, the heat-conducting paths within the passage walls, and therewith also the resistance to the conduction of heat therein, is liable to be greatly increased. This may result in the major part of the total temperature difference lying within said walls, so that only a minor temperature difference lies across the media flowing in said passages, which is naturally counterproductive in the transfer of a large quantity of heat between the media and the passage walls in contact therewith. Consequently, the dimensioning of such heat exchangers is dependent upon optimizing conditions which have not previously been satisfactorily investigated or observed. Another problem is one relating to the particular flow distribution and temperature distribution occurring in the flowing medium as it flows substantially totally laminarly through a flow passage of small cross-sectional dimensions. This problem, which can also lead to greatly impaired heat transfer between flowing medium and the passage walls, if no countermeasures are taken, will be discussed in the following.

Swedish Patent Specification No. 7307165-6 is one of the few patent specifications in which there is described a laminar flow heat exchanger of the aforedescribed kind, to which kind of heat exchanger the heat exchanger of the present invention also belongs. The heat exchanger described in the Swedish Patent Specification, however, is encumbered with a large number of very serious disadvantages, and does not afford a solution to the aforediscussed problems.

The object of the present invention is to provide an improved heat exchanger of the aforementioned viscous kind. The heat exchanger according to the present invention affords effective solutions to the problems arising in connection with laminar-flow heat exchangers, and in comparison with present day conventional turbulent-flow tube and plate heat-exchangers affords significant and important advantages, such as:

(a) High heat-exchange per unit of volume.

(b) A high, general resistance to pressure, and constructed to withstand very high pressures at but small extra cost.

(c) A high degree of safety against the leakage of one heat-exchange medium into the other, since no welds or brazed joints which are liable to produce leaks are required and since there only are a few locations between the two media where a seal is necessary. Each medium can be readily sealed-off separately in a trouble-free fashion, such that should a sealing fault occur it can be readily observed and any heat-transfer medium which may leak away can be collected externally of the heat exchanger, without risk of said fluid leaking into the other medium.

(d) A high degree of safety against leakage between the heat-exchanging media, due to the fact that thick partition walls can be placed therebetween. This also enables a reduction to be made in the quantity of noncorroding material required.

(e) A wide freedom of choice with respect to the materials used, since the need as material which can be welded, brazed or soldered and which is resistant to corrosion is relatively small. This relatively free choice of material enables heat exchangers to be readily designed for work in particularly troublesome fields and in specialized fields. Aluminium is a suitable material for use in heat exchanger designs according to the invention.

(f) Good maintenance properties, since the heat-transfer surfaces which come into contact with the flowing media can, in general, be effectively cleaned and inspected.

(g) Can be given a simple and compact design, which can be adapted to suit differing heat-exchange requirements and application fields at relatively low costs, which together with the relatively free choice of materials, for example aluminium, and of the manufacturing technique applied makes it possible to achieve low manufacturing costs per unit of power.

(h) Wide possibilities of manufacturing heat exchangers of uniform quality by means of highly automatized and efficient methods which can be readily superintended .

(i) Highly suited for both average and low power ratings.

(j) Provide a uniform heat-exchange effect which is not greatly affected by the volumetric flow of the heat-exchange media. In certain cases this means that the amount of expensive liquid required can be lowered, for example cooling water consumed. High pressure can also be prevented with the aid of shunt valves, without affecting the heat-exchange efficiency to any great extent. This results in low operational costs.

(k) Particularly good possibilities of designing optimized heat exchangers in an economically rewarding manner, for example a heat-pump system, and therewith increasing the efficiency and economy, of the system as a whole. In principle this is achieved because the output temperature of one heat-exchange medium can lie comparatively close to the input temperature of the other heat-exchange medium.

The heat exchanger according to the invention is characterized by the features set forth in the accompanying claims.

Figure 1B:
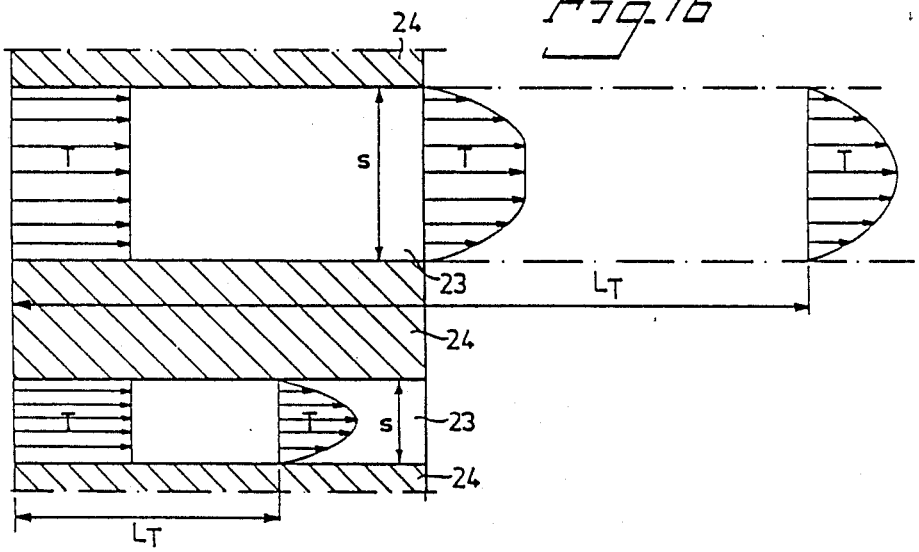
Figure 2:
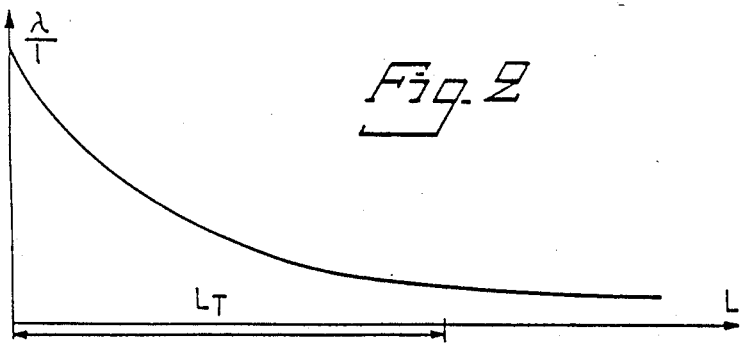

The invention will now be described in more detail with reference to the accompanying drawings, in which FIGS. 1*a* and 1*b* illustrate schematically and respectively the velocity distribution and temperature distribution in a laminar flow of medium in a flow passage:

FIG. 2 is a diagram illustrating the heat transfer between medium and passage walls as a function of the distance from the passage inlet in a laminar medium flow of the kind illustrated in FIGS. 1*a* and 1*b;*

Figure 3A:
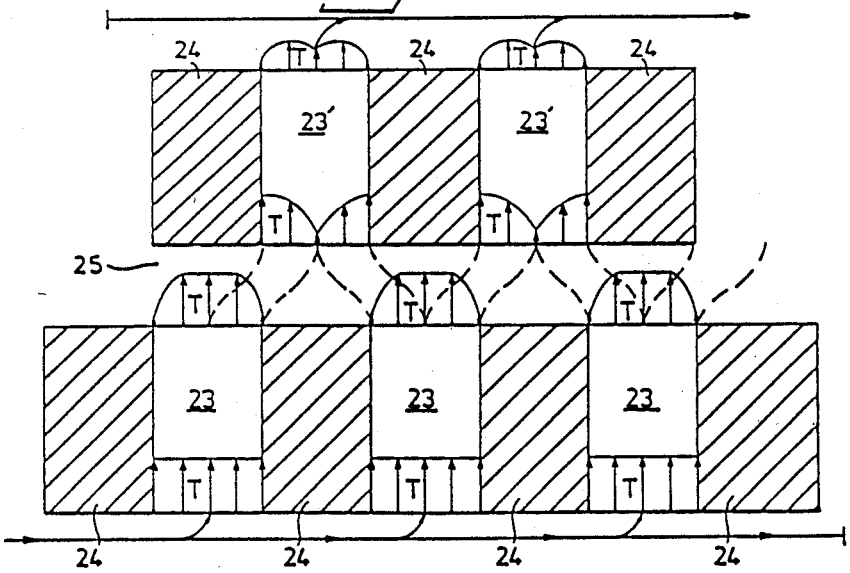
Figure 3B:
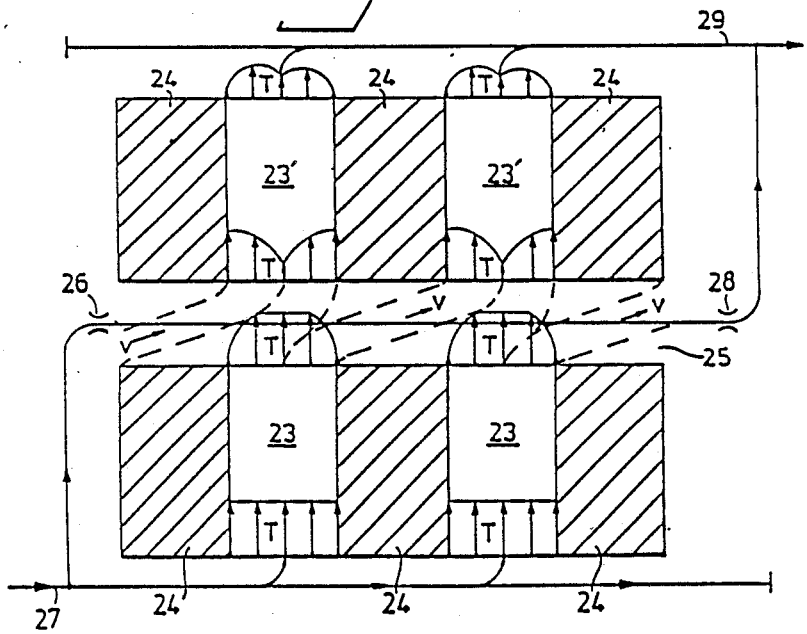
Figure 4A:
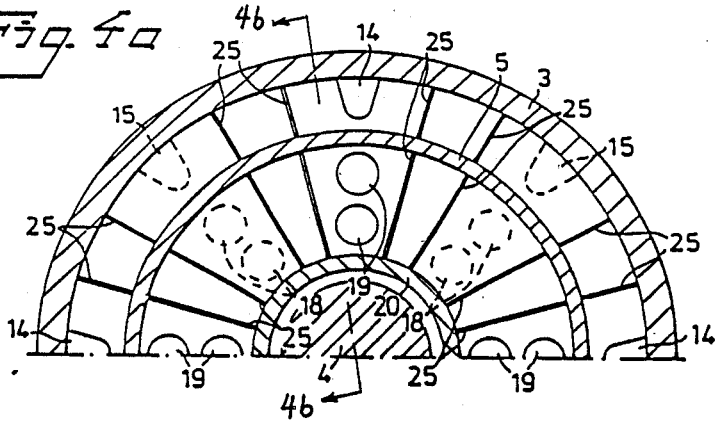
Figure 4B:
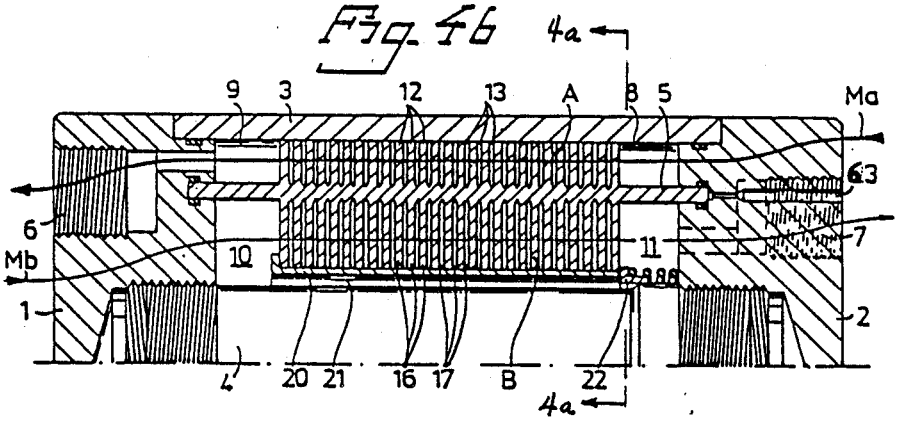
Figure 4C:
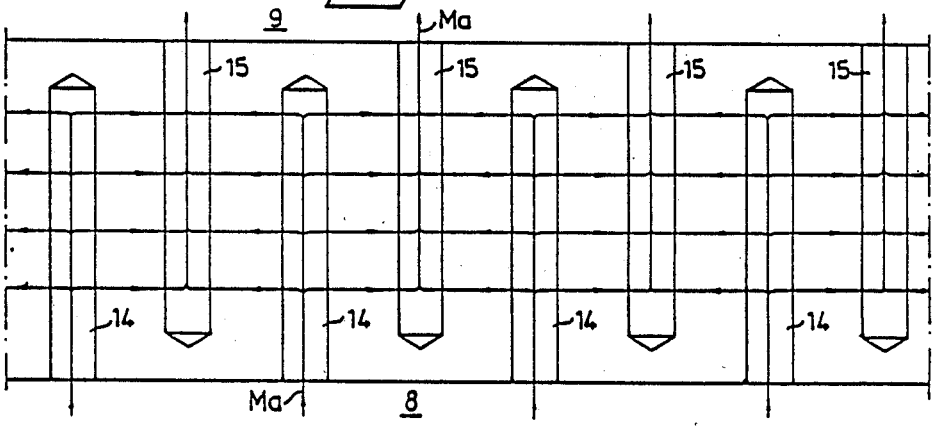

FIGS. 3*a* and 3*b* illustrate schematically two mutually different, advantageous embodiments of the flow passages in a heat exchanger according to the invention, which provide a large transfer of heat between the flowing medium and the passage walls;

FIGS. 4*a* and 4*b* are respectively a schematic partial radial sectional view and a partial axial sectional view of a first embodiment of a heat exchanger according to the invention;

FIGS. 4*c* illustrates schematically the flow pattern of one medium in the heat exchanger illustrated in FIGS. 4*a* and 4*b;*

Figure 5A:
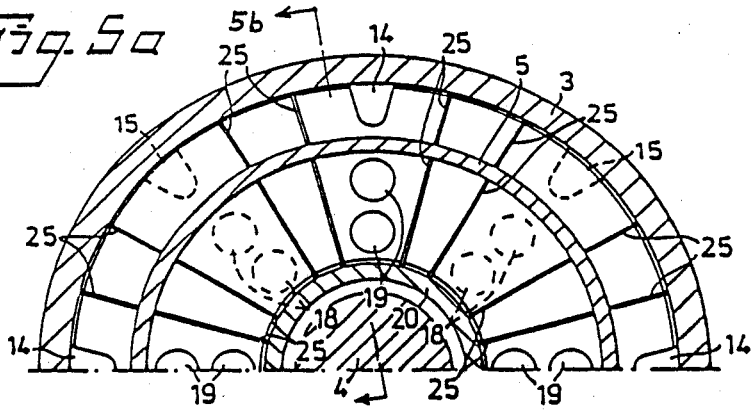
Figure 5B:
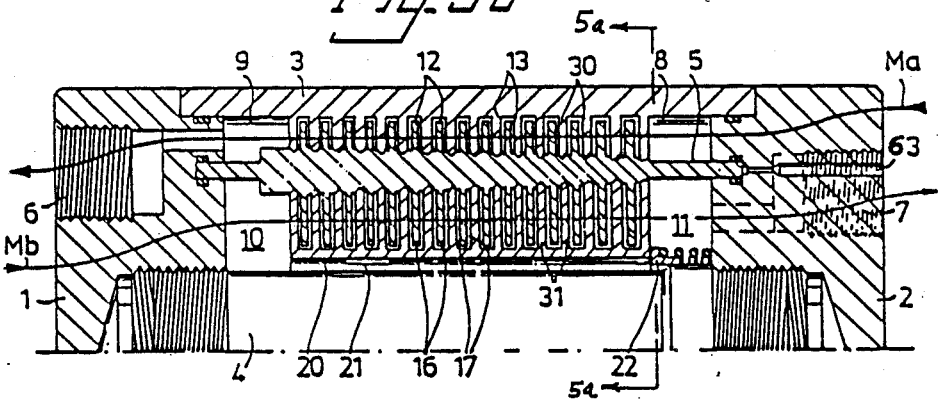
Figure 5C:
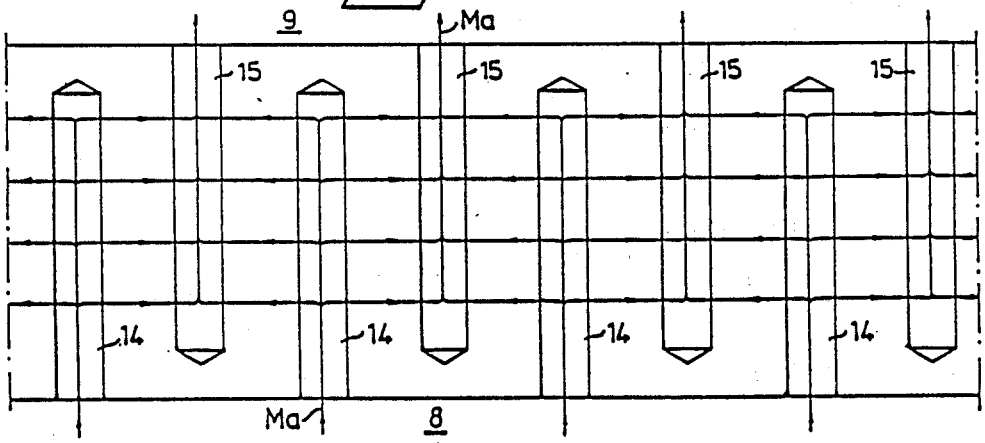
Figure 6A:
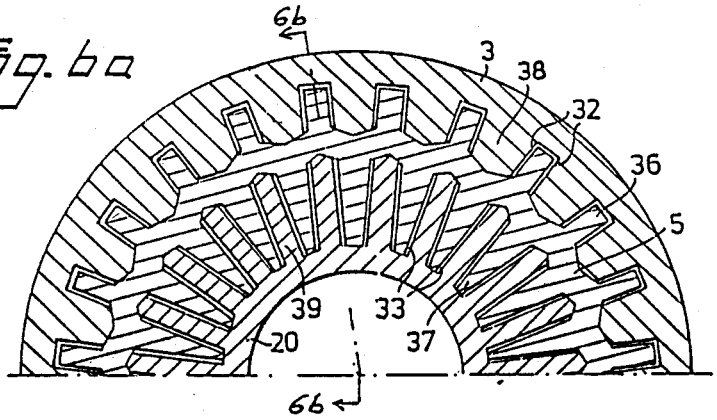
Figure 6B:
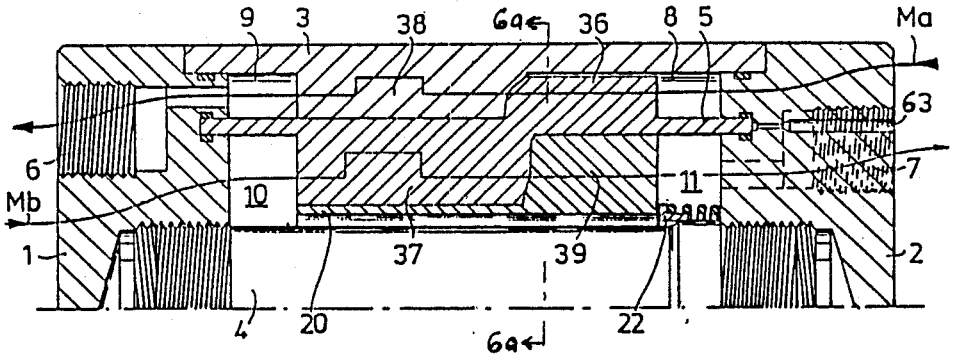
Figure 7A:
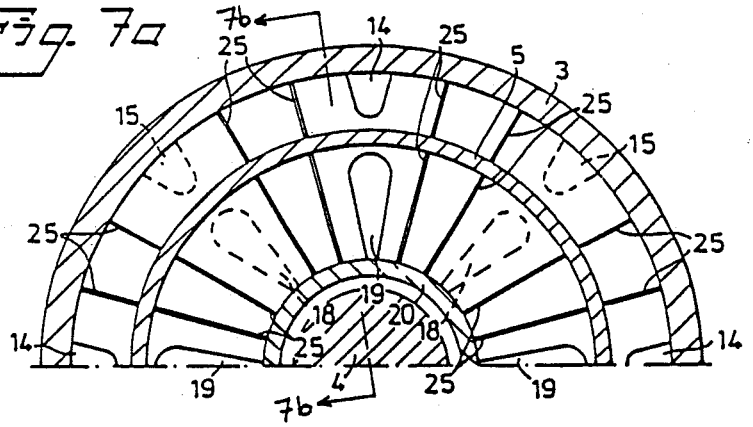
Figure 7B:
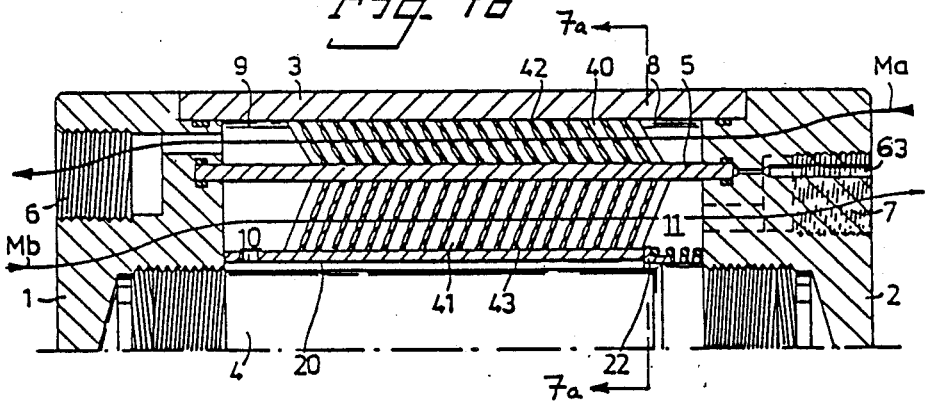
Figure 7C:
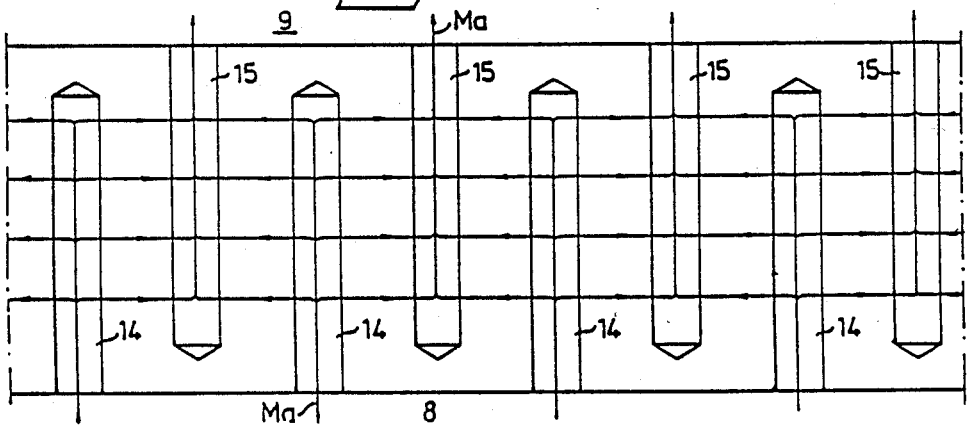
Figure 8:
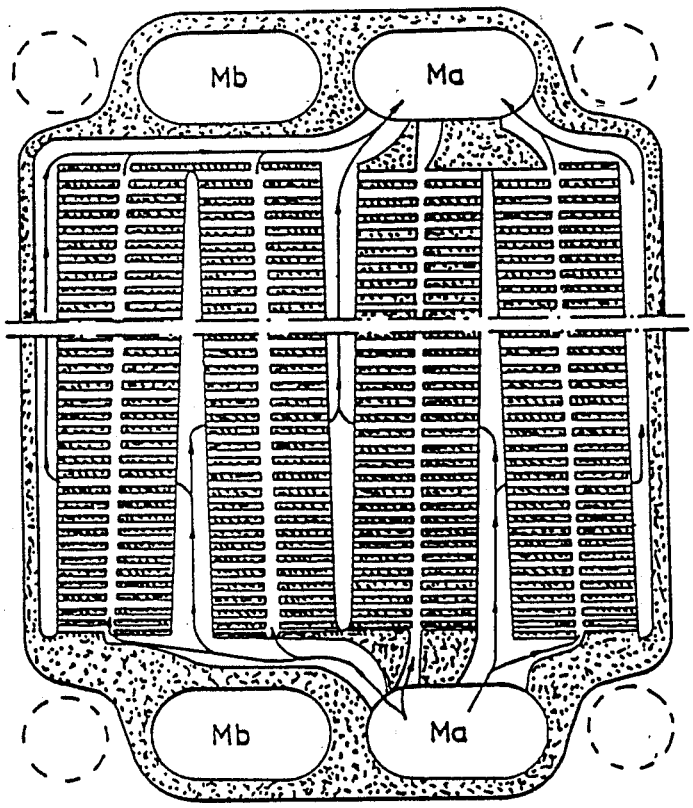
Figure 10:
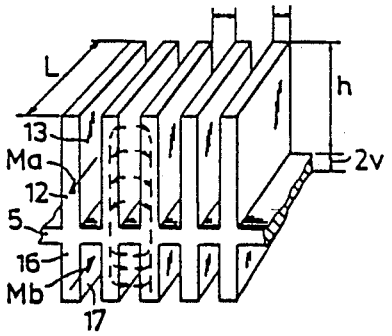
Figure 9A:
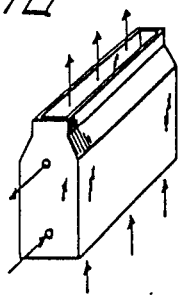
Figure 9B:
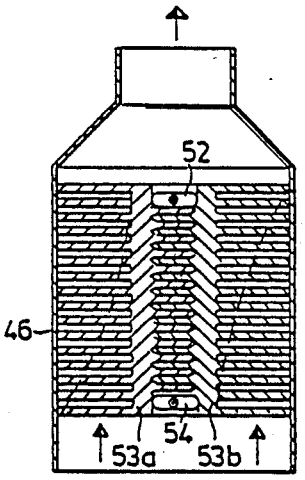
Figure 9C:
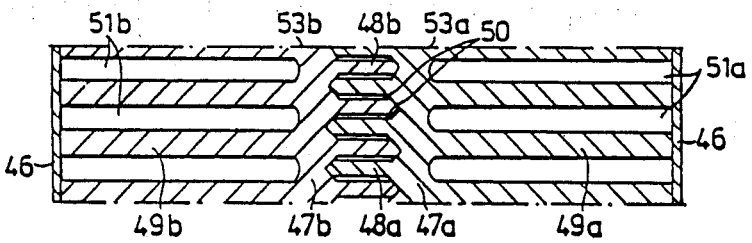

FIGS. 5*a*, 5*b* and 5*c* illustrate, schematically, in a manner similar to FIGS. 4*a–c*, a second embodiment of a heat exchanger according to the invention;

FIGS. 6*a*, 6*b* and 5*c* illustrate schematically, in a manner similar to FIGS. 4*a–c*, a third embodiment of a FIGS. 7*a*, 7*b* and 7*c* illustrate schematically, in a manner similar to FIGS. 4*a–c*, a fourth embodiment of a heat exchanger according to the invention;

FIG. 8 illustrates schematically and by way of example an embodiment of a planar heat exchanger according to the invention;

FIGS. 9*a*, 9*b* and 9*c* illustrate schematically an embodiment of a heat exchanger according to the invention for the exchange of heat between a liquid medium and a gaseous medium;

FIG. 10 is a schematic view, partially in perspective, of that part of a heat exchanger according to the invention in which the exchange of heat takes place, this Figure being used to describe the operational mode and dimensioning of the heat exchanger; and FIGS. 11–15 are diagrams used to describe the heat exchanger dimensioning principles on which the invention is based.

The embodiment of a heat exchanger according to the invention illustrated in FIGS. 4*a* and 4*b* is of cylindrical configuration and comprises two end-walls 1 and 2 and a cylindrical outer shell 3, the ends of which are sealingly joined with a respective one of the end-walls 1 and 2. The end-walls 1 and 2, and therewith the exchanger as a whole, are held together by means of a bolt 4 which extends centrally through the heat exchanger, between the endwalls, and which is screwed thereinto. The annular space located between the outer shell 3 and the bolt 4 is divided by means of a cylindrical, impervious partition wall 5 of high thermal conductivity, into two concentric annular chambers A and B, the two ends of the partition wall 5 being sealingly joined with a respective end-wall 1 and 2. The two characters A and B form flow spaces for a respective one of two media Ma and Mb between which an exchange of heat is to take place Thus, the outer annular chamber A for the medium Ma has an inlet (not visible in the Figure) in the end-wall 2 and an outlet 6 in the end-wall 2, while the character B for the medium Mb has, in a corresponding manner, an inlet in the end-wall 1 and an outlet 7, shown in broken lines, in the end-wall 2. Thus, at one end of the chamber A is an annular inlet space 8 and a similar, annular outlet space 9 at the other end of the chamber. In a corresponding manner, the chamber B has an inlet space 10 adjacent the end-wall 1 and an outlet space 11 adjacent the end-wall 2.

The medium Ma flows from the inlet space 8 to the outlet space 9 in the chamber A through a large number of flow passages which are connected flow-wise in parallel. In the illustrated embodiment, these flow passages are formed by providing on the outer surface of the cylindrical partition wall 5 a large number of mutually parallel, substantially annular flanges or passage walls 12, which form and define therebetween slot-like flow passages 13 of narrow rectangular cross-section extending substantially circumferentially around the partition wall. The medium Ma is passed from the inlet space 8 to these flow passages 13 through a number, four in the illustrated embodiment, of distributing channels 14 (see FIG. 4*a*) which extend axially from the inlet space 8 through the flanges 12, and terminate short of the outlet space 9. The medium Ma is passed from the slot-like flow passages 13 to the outlet space 9 through a corresponding number of collecting channels 15 (see FIG. 4*a*) which extend axially from the outlet space 9 through the flanges 12 and terminate short of the inlet space 8. Thus, the flow pattern of the flow Ma is that illustrated schematically in FIG. 4*c*, namely from the inlet space 8 into the axially extending distributing channels 14, from which the medium flows through the peripherally extending slot-like flow passages 13 (for the sake of simplicity not shown in FIG. 4*c*) to the axially extending collecting channels 15, and through said channels to the outlet space 9. As the medium Ma flows through the narrow slot-like flow passages 13, heat is transferred between the medium Ma and the material of the passage walls 12, said walls being formed integral with the cylindrical partition wall 5 and thus being in good heat-transfer connection therewith.

The flow passages for the medium Mb through the inner annular chamber B are formed in a corresponding manner, by providing on the inner surface of the cylindrical partition wall 5 a large number of annular flanges 16 which form and define therebetween substantially circumferentially extending slot-like flow passages 17. The medium Mb is passed to these flow passages 17 from the inlet space 10 through axially extending distributing channels 18 (see FIG. 4*a*) which extend through the flanges 16 from the inlet space 10 and terminate short of the outlet space 11. The medium Mb is passed from the flow passages 17 to the outlet space 11 through axially extending collecting channels 19 (see FIG. 4*a*), which extend from the outlet space 11 through the flanges 16 and terminate short of the inlet space 10. As the medium Mb flows through the slot-like flow passages 17, heat is transferred between the medium and the flanges or passage walls 16, which are in good heat-transfer connection with the cylindrical partition wall 5. Thus, there is obtained a heat exchange between the two media Ma and Mb through the passage walls 13 and 16 respectively and the liquid-impermeable cylindrical partition wall 5.

The flow passages 17 in the chamber B are delimited radially inwardly by means of a sleeve 20, which is spaced from the outer surface of the bolt 4, so as to form between the sleeve 20 and the bolt 4 an annular space 21. The space 21 forms an over-flow passage for the medium Mb, this over-flow passage normally being closed by means of a spring-loaded sealing ring or valve ring 22, which opens when the drop in pressure along the path from the inlet space 10 to the outlet space 11 exceeds a predetermine value.

The passage walls 12 and 16 respectively may comprise separate, annular, mutually parallel flanges on the partition wall 5, or they may be formed by a helical flange extending along both sides of the cylindrical partition wall 5.

As will be understood, the illustrated heat exchanger presents a very large contact surface-area and therewith heat-transfer surface-area between respective media Ma, Mb and the passage walls 12, 16 respectively, which are in good heat-transfer connection with the cylindrical partition wall 5. It will also be understood that the risk of leakage between the media Ma, Mb is very small, since the partition wall 5 has the form of a one-piece structure lacking any form of joints, and because the thickness of the partition wall may be such that there is very little chance of the wall being eaten away by corrosion. Only two sealing locations are found, namely at the ends of the partition wall 5. These seals can, to advantage and at relatively low cost, have the form of double seals (one for each medium) presenting therebetween a passage 63, in which any leakage can be collected and passed to a readily monitored location externally of the heat exchanger for collection and for indication that a leakage has occurred. In this way, it is possible to prevent the leakage of one medium into the other, even though the seals arranged at the ends of the partition wall 5 should become faulty.

FIG. 10 is a principle, schematic sectional view of that part of a heat exchanger according to the invention, for example the heat exchangers illustrated in FIGS. 4*a*–4*c*, in which the exchange of heat takes place. Thus, FIG. 10 illustrates the partition wall 5, which is provided on one side thereof with flanges or passage walls 12, which define therebetween the slot-like flow passages 13 for the one medium Ma, while the other side of the partition wall is provided in a similar manner with flanges or passage walls 16, which therebetween define the flow passages 17 for the other medium Mb. In FIG. 10, the width of the flow passages seen in a direction parallel to the partition wall 5 is referenced s, the height of the flow passages at right angles to the partition wall 5, which coincides with the height of the passage walls, is referenced h, the thickness of the passage walls is referenced t, and the thickness of the partition wall 5 is referenced 2v, these references being those used in the following description. The length of the flow passages in the flow direction is referenced L. In a heat exchanger according to the invention, the flow passages are dimensioned so that the flow of media therein is substantially laminar throughout the whole cross-sectional area of the passages. Heat is transferred from one medium to the other medium in the manner illustrated by arrows in FIG. 10, by first conducting heat from one medium in a direction transversely of its conducting passages and out towards the passage walls, whereafter the heat is conducted through the passage walls to the partition wall and from there into the passage walls between the flow passages for the other medium, to which the heat is conducted from the passage walls into the flowing medium in a direction transversely to the passage walls and the flow passages.

When heat is conducted from one medium to another in a heat-exchange process, the following principle formula can be written for the thermal energy, or heat being transferred:

$$P = A \cdot \frac{\Delta T}{l} \cdot \lambda \qquad (1)$$

in which A is the area through which the heat is conducted, ΔT is the temperature difference along the length of the heat-conducting path 1 and λ is the thermal conductivity along the heat-conducting path. In a heat exchanger there is always found at least two media and a partition wall separating said media.

The thermal conductivity of the two media is a given value for each purpose to be fulfilled by the heat exchanger, as is also the difference in temperature of the two media prior to effecting an exchange of heat therebetween, and in many cases also after said heat exchange has taken place. Consequently, the only heat-exchanger parameters which can be altered or influenced are: the distribution of the total temperature difference between the two media and across the partition wall; the material from which the partition wall is made; and the thickness of said wall and its effective surface area, i.e. the surface area of the partition wall with which the media come into contact. The heat transmission paths in the two media can be influenced by the selection of the flow pattern of the media and the effect produced thereby.

In order to achieve low heat-exchanger costs, size, weight, etc., a heat exchanger should, in general, have a high transferred thermal energy P, hereinafter referred to as transferred heat, per unit of volume V, while having, at the same time, acceptable values with respect to pressure endurance and pressure drop. In a heat exchanger according to the invention, a decrease in the width s of the flow passages will result in a decrease in the heat-transmission path in the media and an increase in the contact area of the media with the passage walls. Consequently, in a heat exchanger according to the invention the width s of the flow passages should be as small as possible, while taking into account the danger of blockages occurring as a result of solids present in the flowing media and the deposits liable to coat the passage walls. In practice, the passages suitably have a width s of about 1.5 mm and therebelow. It will be understood that in a heat exchanger according to the invention, the surfaces of the wall structure with which the two media come into contact can be given mutually different sizes for respective media, as opposed to what is normally the case in turbulent-flow heat exchangers. Moreover, in a heat exchanger according to the invention, the heat-transmission path in said wall structure will be relatively long, namely within the passage walls, so that the temperature difference or temperature drop along the heat-transmission path in the wall structure is normally of the same order of magnitude as the temperature differences or temperature drops along the heat-transmission paths in the two media. As is normally the case, the thickness 2v of the partition wall 5 must be chosen with a view to the desired mechanical strength of the wall and to its resistance to corrosion, etc., although in the case of a heat exchanger according to the invention the partition wall may have a relatively large thickness, since the thickness of the wall has but a relatively small effect on the total volume of the heat exchanger.

When attempting to achieve an optimum with respect to transferred heat P per unit of volume V, it is possible, on the basis of a selected passage width s, the manufacturing techniques used and the properties of the flowing media, to calculate both an optimal flow-passage height h, and therewith an optimal passage-wall height, and an optimal passage-wall thickness t , the passage width s being chosen with respect to the risk of blockages occurring in the passages, as beforementioned, and with respect to manufacturing costs. This calculation can be made for one medium at a time, in respect of the heat-transfer between said medium and the central plane of the partition wall (5 in FIG. 10).

In this respect, it is surprisingly found that the optimum thickness of the passage walls is independent of the width of the flow passages. The optimal thickness of the passage walls can be given, with acceptable accuracy, by the expression $$t_{opt} = 2\,h\sqrt{\frac{\lambda_M}{\lambda}} \qquad (2)$$

where t = passage-wall thickness (m)

h = flow-passage height and therewith passagewall height (m)

λ = the thermal conductivity of the material in the passage walls (W/mK)

$\lambda_M$ = the thermal conductivity of the flowing medium (W/mK).

If the thickness of the passage walls is, at the same time, optimized in accordance with the above formula (2), it is possible to calculate the optimal height of the flow passages, and therewith the passage walls, with the aid of the following system of equations $$H^3 + H^2 (S + 1.5) - 0.5\, S^2 = 0 \qquad (3)$$

$$S = \frac{s}{2v}\sqrt{\frac{\lambda}{\lambda_M}}$$

-continued $$H = \frac{h}{v}$$

in which v = half the thickness of the partition wall (5 in FIG. 10) (m) and H and S are two dimensionless quantities.

Figure 11:
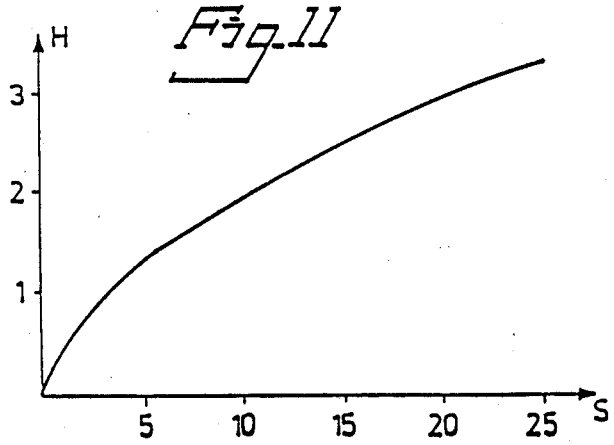

The solution of this system of equations can be illustrated by the curve shown in FIG. 11.

The optimal values according to the above give relatively small values for both the height h of the flow passages and the thickness t of the passage walls. Around these optimal values, however, there is found a relatively wide range within which the amount of heat exchanged per unit of volume decreases but slowly. Thus, there can be used a greater passage height h and a greater passagewall thickness t, without drastically reducing the heat exchanged per unit of volume.

Figure 12:
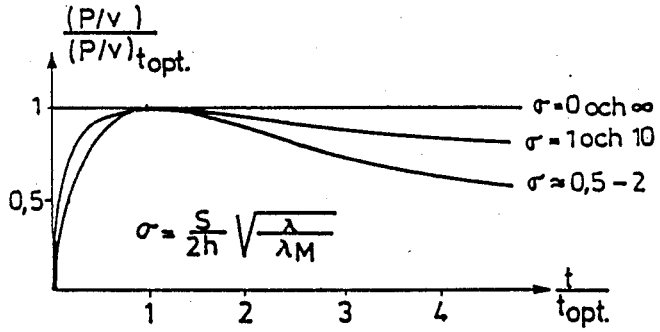

The manner in which changes in the thickness t of the passage walls from the optimal value t influences the heat-exchange effect can be illustrated by the curves shown in FIG. 12. In this diagram (P/V) = heat-exchange per unit volume $(P/V)_{topt}$ = heat-exchange per unit volume when the thickness t of the passage walls is the optimal thickness.

Figure 13:
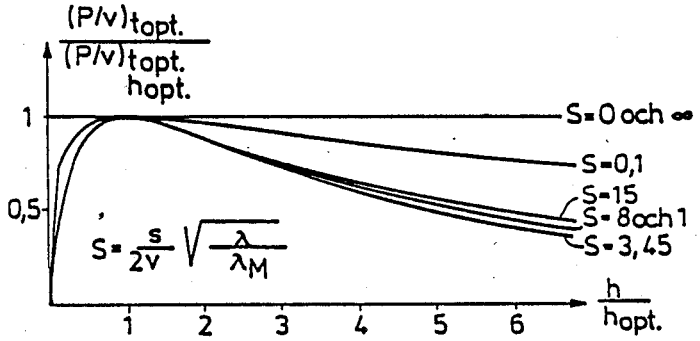

The affect caused by deviations in the height h of the flow passages, or passage walls, can be illustrated by means of the curves shown in FIG. 13.

As with all heat exchangers, when dimensioning a heat exchanger constructed in accordance with the present invention the heat exchanger must be designed to fulfil the purpose for which it is intended, and therewith a practical and economical solution must be provided. Thus, the design of the heat exchanger is highly dependent upon its working field, and consequently wide differences are to be found even among conventional heat exchangers intended for different working fields. Despite the fact that the heat exchanger according to the present invention possesses many good properties, the design thereof must still be adapted to the use for which it is intended Primarily, the width s of the flow passages must be chosen with respect to the degree of purity of the flowing medium and to the risk of coatings, e.g. lime deposits, forming on the passage walls. The passages are given the smallest width s possible in practice. The material from which the partition wall and the passage walls are made is mainly chosen with respect to corrosion risks. Having knowledge of the width s of the flow passages and the nature of the material in the partition wall and passage walls, it is then possible to dimension the height h of the flow passages, and therewith the passage walls, and the thickness t of the passage walls.

As a rule, when designing a heat exchanger, efforts are made to achieve a high heat-transfer per unit volume while, at the same time, taking into account manufacturing costs and available manufacturing methods, and also such desiderata as pressure-endurance, proof against leakage, non-corrosion properties, etc. One consequence of these desiderata is a desire to minimize the number of passage walls, which can generally be effected by increasing the height of the flow passages, and therewith of the passage walls. In this connection it should be noted that the cause-relationships existing in a heat-exchanger according to the invention and in a conventional turbulent-type heat exchanger are not the same. For example, the amount of heat transferred in a conventional turbulent-type heat exchanger increases substantially linearly with the mutual contact surface area of the media and the wall structure separating the two media. This also applied to a heat exchanger designed in accordance with the present invention when the aforesaid contact surface area is increased solely by increasing the number of flow passages without changing the width and height of the flow passages and the thickness of the passage walls at the same time. If, on the other hand, the contact surface area is changed solely by changing the width and height of the flow passages and the thickness of the passage walls, while leaving the effective surface area of the partition wall (5 in FIG. 10) unchanged, the relationship between the effective contact surface and the amount of heat transferred is not a linear relationship. This highly significant fact has not been realized and taken into account in previously proposed heat exchangers operating with substantially total laminar flow, and consequently highly disadvantageous dimensions, for example passage height and passage-wall thickness, have been proposed.

Figure 14:
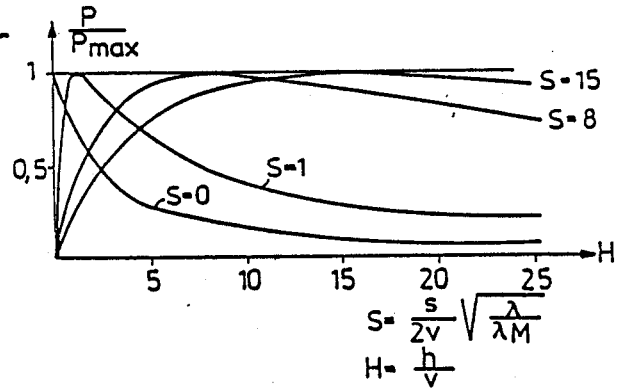
Figure 15:
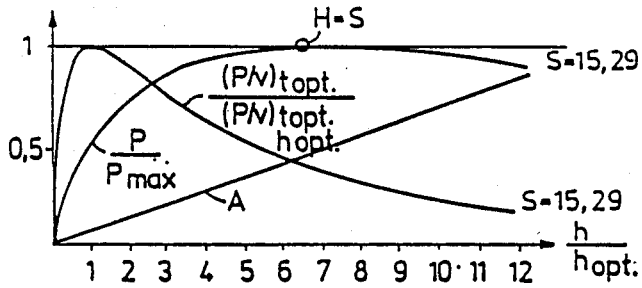

The events taking place when the area of the partition wall (5 in FIG. 10) is held constant and only the height h of the flow passages is varied, while the thickness t of the passage walls is constantly the optimal thickness, is exemplified by the diagrams in FIGS. 14 and 15. In this respect, the diagram in FIG. 14 illustrates how the transferred heat P varies in relation to the maximum possible transferred heat $P_{max}$, when the height h of the flow passages varies. The diagram in FIG. 15 illustrates with the aid of three curves how the transferred heat per unit volume P/V, the transferred heat P and the contact surface area A respectively vary with varying heights h of the flow passages, when the dimensionless quantity S has a value of 15.29.

It will be seen from these diagrams that the highest transferred-heat density P/V is, of course, obtained at the optimal passage height $h_{opt}$. The diagram in FIG. 15 also shows, however, that the maximum heat transferred $P_{max}$ is obtained when the two dimensionless quantities H and S are equal to one another. In the example, S = 15.29, illustrated in the diagram in FIG. 5, this occurs when the height h of the flow passages is about 6.1 times as great as the optimal passage height $h_{opt}$. At this value, the heat transferred per unit volume P/V, the so-called transferred heat density, has fallen to about 45 % of its maximum value. It will be seen, however, that about 90 % of the maximum amount heat transferred $P_{max}$ is obtained already when the height h of the flow passage is about 3.1 times as great as the optimal passage height $h_{opt}$. In this case the heat-transferred density has only fallen to about 73 % of its optimal value.

It will also be seen from the curves in the diagrams shown in FIGS. 12 and 13 that the heat-transferred density P/V falls but relatively slowly from its optimal value, even when the thickness t and the height h of the flow passage wall are increased considerably from their optimal values. Similarly, a moderate decrease in the thickness t and the height h of the passage walls from the optimal values results in a relatively small reduction in the heat-transferred density P/V, down to 50 %. Thus, for a practical and economical design of a heat exchanger according to the present invention, with respect for example to manufacturing costs and manufacturing techniques, the height of the passages, i.e. the height of the passage walls, may range up to about 350 % of the optimal value, although preferably not above a value corresponding to H=S, while the thickness t of the passage walls may lie within a range of between about 30 % and 500 %, and preferably between 100 % and 350 % of the optimal thickness. An increase in the height h of the flow passages and the thickness t of the passage walls to about three times the respective optimal value each normally result in at the most a reduction of the heat-transferred density P/V down to 70 %, i.e. said density is generally greater than 50 % of its optimal value if both measures are taken simultaneously. It should be observed in this connection that the optimal passage height $h_{opt}$ is normally very small, and hence the use of this optimal passage height results in a requirement of relatively many flow passages and therewith many passage walls, in order to obtain the requisite volume and heat transfer.

The following examples illustrate the typical dimensions obtained with a heat exchanger designed in accordance with the present invention, these examples being based on extremes with respect to choice of materials, namely a material of good thermal-conductivity, such as aluminium ($\lambda \approx 190$), and a material of poor thermal-conductivity, such as stainless steel ($\lambda \approx 23$). The following starting data has been selected in the examples:

$s=0.4$ mm
$2v=1.0$ mm
$\lambda_{Al}=180$ for aluminum
$\lambda_{Rf}=23$ for stainless steel
$\lambda_{M}=0.13$ for mineral oil
These values give:
$S_{Al}=15.29$
$S_{Rf}=5.32$ In accordance with the curve in FIG. 11, this in turn gives:

$$H_{Al} \approx 2.45 \text{ and } H_{Rf} \approx 1.25,$$

which, according to the third equation of the equation system (3), in turn gives:

$$h_{opt\,Al}=1.23 \text{ and } h_{opt\,Rf}=0.625$$

If the flow passages are, for example, made 3.25 times higher than the optimal passage heights, the passages obtain the heights $h_{Al} \approx 4.0$ mm and $h_{Rf} \approx 2.0$ mm.

In this case the heat-transferred density P/V has decreased to about 70 % of its maximum value, as illustrated in the diagram in FIG. 15. With the aid of the equation (2), the optimal thickness of the passage walls can now be calculated to $$t_{opt\,Al}=0.209 \text{ and } t_{opt\,Rf}=0.301, \text{ respectively.}$$

If, with respect to manufacture, a more practical and economic passage-wall thickness is chosen, a thickness of 0.5 mm can be considered suitable. This corresponds to an increase in the passage-wall thickness of 2.39 times in respect of aluminium and 1.66 times in respect of stainless steel. This corresponds to a reduction in heat-transferred density P/V down to about 85 % in the case of aluminium and about 94 % in the case of stainless steel, in relation to the maximum value possible in each case, as illustrated by the curve in FIG. 12. Thus, when the passage height and the passage-wall thickness have the above selected values, the resultant heat-transferred density in the case of the aluminium is down to about 59.5 % and in the case of stainless steel about 65.8 % of that obtainable with an optimal passage height and optimal passage-wall thickness. It is of interest in this connection to note that in these examples the heat-transferred density of the stainless steel heat exchanger is about 90 % of the heat-transferred density of the aluminium heat exchanger. Thus, a heat exchanger according to the present invention can be designed to produce a high heat-transfer per unit volume, even when using material of relatively low thermal conductivity. A heat exchanger according to the invention dimensioned within the aforegiven approximately optimal and practical dimensional ranges is thus not unduly affected by the thermal conductivity of the material used in the walls. One consequence hereof, however, is that the passage height, and therewith the passage-wall height, must be decreased when using material of poorer thermal conductivity, which generally leads to a requirement for a greater number of flow passages, and therewith of passage walls.

As mentioned in the aforegoing, a fundamental principle of a heat exchanger according to the invention is that the parallel-connected flow passages 13 and 17 respectively in the embodiment illustrated in FIG. 4 have a flow cross-section which is so dimensioned with respect to the medium in question that the flow of said medium through the flow passages is substantially completely laminar, without any central turbulent zone. Such a laminar flow has certain characteristics which are of great significance to the transference of heat between the flowing medium and the passage walls.

FIG. 1*a* illustrates schematically the flow velocity in a laminar medium-flow passing through a passage 23 defined by walls 24, the relationships being illustrated in respect of two different passages of mutually different passage width s, between the passage walls 24. It is assumed that the volumetric flow is equally as large through both passages. As illustrated, the flow velocity at the entrance to the passages is equally as great over the whole width of the passage, and thus the velocity-distribution profile is substantially linear. As the medium continues to flow through the passage 23, however, the velocity decreases in the vicinity of the passage walls 24, while increasing in the centre of the passage, so that the velocity-distribution profile progressively assumes a more parabola-like configuration. It will be understood that this means that the volumetric flow through the passage is increasingly concentrated towards the centre of the passage, while the volumetric flow decreases in the proximity of the passage walls. After the medium has travelled a certain distance through the passage, then velocity-distribution profile assumes a substantially stable configuration. This flow distance is normally referred to as the velocity entry stretch, and is referenced $L_w$ in FIG. 1*a*. As illustrated, this entry stretch $L_w$ becomes progressively shorter as the passage width s narrows. Thus, in the example illustrated in FIG. 1*a* the entry stretch $L_w$ is longer than the wide passage but shorter than the narrow passage. It should be observed that what has been said applies in principle only when the viscosity of the flowing medium does not change along the flow path. If the viscosity of the medium is dependent upon temperature, as in the case of oil for example, and the medium is cooled as it flows through the passage, so that the viscosity of the medium gradually increases, the velocity-distribution profile will continue to change, even beyond the aforedefined entry stretch $L_w$, in a manner such that the volumetric flow of said medium becomes more and more concentrated towards and at the centre of the passage.

FIG. 1*b* illustrates in a similar manner the temperature distribution in the medium flowing through the passage 23. Although, for the sake of simplicity, the circumstances illustrated are those prevailing when the flowing medium is cooled, i.e. when heat is transferred from said medium to the passage walls 24, it will be understood that the same also applies when heating the medium flow. The temperature of the medium at the entrance to the passage is also in this case substantially constant across the whole width s of the passage, so that the temperature-distribution profile is substantially linear. As the medium flows through the passage, however, the temperature decreases progressively in the vicinity of the passage walls 24, through transfer of heat from the medium to said passage walls, so that the temperature-distribution profile progressively changes to a parabola configuration, to obtain finally a substantial stable form after the medium has travelled along a given entry stretch $L_T$, the temperature distribution subsequently decreasing solely in magnitude, without changing the shape of said profile. In principle, this is also only true when the viscosity of the medium remains constant. If the viscosity of the medium increases along the flow path, the shape of the temperature distribution profile continues to change, even beyond the entry stretch $L_T$, in such a manner as to become progressively more pointed. The entry stretch $L_T$ of the temperature also becomes shorter with narrower passage widths s, and in the example illustrated in FIG. 1*b* the temperature entry stretch $L_T$ is longer in the broader passage and shorter in the narrower passage. In general, the temperature entry stretch $L_T$ is longer than the velocity entry stretch $L_w$.

Since, as beforementioned, the heat transfer between a substantially totally laminar medium flow and the walls defining the flow passage is effected by heat conduction between each individual element in the medium flow and the nearest located passage wall, it will be understood that the phenomena described above and illustrated in FIGS. 1*a* and 1*b* cause the transfer of heat between the medium flow and the passage to be progressively poorer, the further away one comes from the passage entrance. This decrease in heat transfer is caused by a gradual decrease in the temperature gradient in the vicinity of the passage wall, and because a major part of the volumetric flow of the medium is concentrated at the centre of the passage, so as to decrease the volumetric flow in the vicinity of the passage walls. FIG. 2 is a curve illustrating schematically the heat transfer as a function of the length of the flow path of the medium from the passage entrance, and shows that the heat transfer decreases very rapidly at increasing distances from the passage entrance. It will be understood that this phenomenon counteracts the good heat transfer obtainable with a laminar medium flow in a flow passage of very small width s. At the end of the temperature entry stretch $L_T$, where according to the curve in FIG. 2 substantially stable heat-transfer conditions prevail between medium and passage wall, it is possible to define in the flowing medium an equivalent heat-transfer path which is about 25 % of the width s of the flow passage. It is obvious that the conditions prevailing in the vicinity of the passage entrance, i.e. within the temperature entry stretch $L_T$, are advantageously applied in order to obtain the best possible heat transfer. As will be understood, within this entry stretch the equivalent thermal transmission path in the medium is less than s/4.

It will be understood that the best heat transfer would be obtained if it were possible to produce over a larger part of the length of the flow passage those heat-transfer conditions which prevail in the vicinity of the passage entrance, i.e. within the temperature entry stretch $L_T$ at the beginning of the curve in FIG. 2. According to a particularly advantageous embodiment of the invention, this can be achieved by providing the passage walls, at at least one location along the length of the passage, with slot-like interruptions. In this way, the velocity-distribution profile is re-established at the locations of the slot-like interruptions in the passage walls, so as to again become substantially linear upon continuation of the flow passage downstream of the slot-like interruption. It can be said that the slot-like interruption in the passage walls constitutes the introduction of a further velocity entry stretch. Naturally, this results in a certain improvement in heat transfer The temperature distribution profile, however, is not affected to any appreciable extent by the presence of such a slot-like interruption in the passage walls, unless further measures are taken. According to particularly advantageous embodiments of the invention such further measures are made possible, however, by providing means whereby the temperature distribution profile can also be improved at the location of the slot-like interruption in the passage walls. This improvement can be effected in either of the two ways illustrated in FIGS. 3*a* and 3*b*.

FIG. 3*a* illustrates schematically a plurality of mutually parallel flow passages 23 separated by passage walls 24, all of which are provided with a slot 25 extending transversely to the longitudinal direction of the passages. The flow-passage extensions 23' located downstream of the slot 25 are, in this case, displaced laterally in the direction of extension of the slot 25 relative to the flow passages 23 located upstream of the slot. This means that the flow of medium leaving a passage 23 upstream of the slot 25 will not flow directly into an oppositely located flow passage downstream of the slot 25, but will instead, in principle, be divided between two adjacent flow passages 23' downstream of the slot 25. As illustrated in FIG. 3*a*, in this way those flow layers which, upstream of the slot 25, were located in the vicinity of the passage walls 24 and thereby obtained a low temperature will flow in the vicinity of the centre of the passages, in the passage extensions 23' located downstream of the slot 25. Correspondingly, the flow layers which flowed in the centre of the passages 23 upstream of the slot 25 and which therefore have a high temperature will flow in the vicinity of the passage walls, in the passage extensions 23' downstream of the slot 25. In this way the velocity distribution profile is effectively re-established downstream of the slot 25, so as to be substantially linear, as is also the temperature distribution profile, so as again to obtain a high temperature gradient in the vicinity of the passage walls 24. In this way, the heat transfer conditions prevailing at the entrance to the passage extensions 23' downstream of the slot 25 will be approximately as good as those prevailing at the entrances to the low passages 23 upstream of the slot 25.

A further, and likely more advantageous manner of achieving the same result is illustrated in FIG. 3*b*. The mutually parallel flow passages 23 of this embodiment have also been provided with a transverse slot 25 at a location along the length of the passages. In this embodiment, however, the passage extensions 23' downstream of the slot 25 are located in register with the passage sections 23 upstream of the slot 25, which can afford an advantage from the manufacturing aspect. On the other hand, the slot 25 traversing the passages is arranged so that one end of said slot communicates with a medium inlet 27, optionally via a suitable constriction 26, while the other end of said slot communicates with a medium outlet 29, optionally via a constriction 28. In this way there is obtained a flow of medium through the slot 25 at right angles to the laminar medium flows passing through the passages 23. As a result hereof, the laminar flows leaving the passages 23 upstream of the slot 25 are displaced laterally before entering the passage extensions 23' downstream of the slot 25. This enables the result schematically illustrated in FIG. **3*b* to be principally achieved, namely that flow layers which flow in the vicinity of the passage walls 24 in the passages 23 upstream of the slot 25 will flow in the vicinity of the centre of the passage extensions 23' downstream of the slot 25. Thus, in this embodiment the velocity distribution profile is also re-established downstream of the slot 25, to provide a substantially linear configuration, and the temperature distribution profile is significantly improved, so that the temperature gradient in the proximity of the passage walls 24** increases.

A further important advantage obtained with the transverse slot 25 is that it interrupts the conduction of heat through the passage walls 24 in the axial direction of the flow passages. Since such heat conduction in the passage walls along the flow passages also gives rise to a substantial reduction in the total heat transfer, such an interruption affords a considerable improvement.

As will be understood, more than one transverse slot, for example two, may be arranged at a given distance apart along the length of the flow passages 23. An arrangement of more than two slots in each flow passage, however, will normally only afford negligible further improvement.

In the embodiment of a heat exchanger according to the invention illustrated in FIGS. **4*a*–*c* each of the flow passages 13 and 17 for the respective media Ma and Mb is provided with two transverse slots 25. The ends of the slots 25 communicate with the inlet spaces 8 and 10 and the outlet spaces 9 and 11** respectively for the two media Ma and Mb.

The temperature entry stretch $L_T$ for a flow passage having a slot-like, narrow-oblong cross-section can be calculated approximately, by means of the following formula $$L_T = 0.05 \cdot \frac{Q}{h} \cdot \frac{\rho\, c_p}{\lambda_M} \cdot s$$

where

Q = the volumetric flow through the passage ($m^3/s$)

$\zeta$ = the density of the medium ($kg/m^3$)

$c_p$ = the specific heat of the medium (Ws/kg K)

The number of transverse slots per flow passage should be at least one, although said number can be advantageously selected so that the mutual distance therebetween corresponds approximately to the length of the temperature entry stretch $L_T$, or is shorter than said length.

In the aforediscussed dimensioning and optimizing rules, it has been assumed that the equivalent heat-transfer path in the medium flowing in a passage is about ¼ of the passage width s, which as beforementioned applies to that part of the passage located downstream of the temperature entry stretch. When transverse slots are arranged in the passage walls in the aforedescribed manner, the equivalent heat-transfer path in the flowing media will be shorter, and this should be taken into account when dimensioning the passage height and thickness of the passage walls.

When dimensioning a heat exchanger according to the invention the drop in pressure in the flow passages is also of considerable interest. The acceptable pressure drop within a flow passage at the smallest volumetric flow through the passage which can be permitted with respect to the desired heat-exchange, and when coatings on the passage walls begin to build up to a maximum permitted thickness, can be calculated from the equation:

$$\Delta p = \frac{12\, Q \cdot \mu \cdot L}{h(s - 2B)^3}$$

where

Q = the lowest acceptable volumetric flow through the flow passage ($m^3/s$)

$\mu$ = medium viscosity ($Ns/m^2$)

L = flow-passage length in the flow direction (m)

h = flow-passage height (m)

s = flow-passage width (m)

B = coating thickness (m)

A low pressure drop can be achieved in a heat exchanger according to the invention, by decreasing the length L of the flow passages in comparison with the normal length of such passages in conventional heat exchangers. When the length L of the flow passages is decreased, the number of flow passages must be increased, which results in the total volumetric flow of the media through the heat exchanger being divided between a larger number of flow passages, so that the volumetric flow per passage decreases. Thus, since in this way both the length L of the flow-passages and the volumetric flow Q through each flow-passage is decreased, the pressure drop $\Delta p$ in the flow-passages is also low. An acceptable pressure drop can also be achieved in the case of extremely viscous media, such as mineral oil, by shortening the length of the flow-passages and increasing the number thereof, without serious disadvantage.

When designing a heat exchanger according to the invention for the exchange of heat between two liquids, the individual flow passages may be given the following typical dimensions, calculated on the basis of the circumstances and conditions aforediscussed: Length L in the flow direction about 10–60 mm Height h in general beneath 8 mm and often between 2 and 5 mm Width s normally 0.2–1.5 mm, and often beneath 1 mm.

In this respect, the size of the passage width s is chosen with a view to short equivalent heat-transfer paths and with a view that a coating of up to 0.1–0.2 mm can, in certain cases, be accepted, before needing to clean the surfaces of the passage walls. The selected passage height may also be varied in dependence upon the media flowing through said passages, so that the medium having the lowest thermal conductivity and the highest viscosity is given a larger share of the volume of the heat exchanger, and therewith a greater flow-passage height.

A number of different structural embodiments of heat exchangers according to the invention will now be described by way of example.

The embodiment of a heat exchanger illustrated in FIGS. 5*a–c* differs from the heat exchanger illustrated in FIGS. 4*a–c*, insomuch as the passage walls between the flow-passages 13 for the medium Ma and the flow-passages 17 for the medium Mb are alternately defined by flanges 12 and 16 respectively, formed integrally with the cylindrical partition wall 5 on both sides thereof, and by flanges 30 formed integrally with the inner surface of the outer cylindrical shell 3 and flanges 31 formed integrally with the outer surface of the inner sleeve 20. The edges of the flanges 30 and 31 are in mechanical contact with the partition wall 5 and are guided into correct positions by means of V-shaped or U-shaped recesses in the partition wall 5. In this case, all of the flanges 12, 16, 30, 31 defining the passage-walls extend helically, so that the various heat-exchanger components can be screwed together. The thickness of the partition wall 5 suitably varies slightly, so as to be conical in shape, whereby good mechanical contact is obtained between the components when assembling the heat exchanger.

Figure 6C:
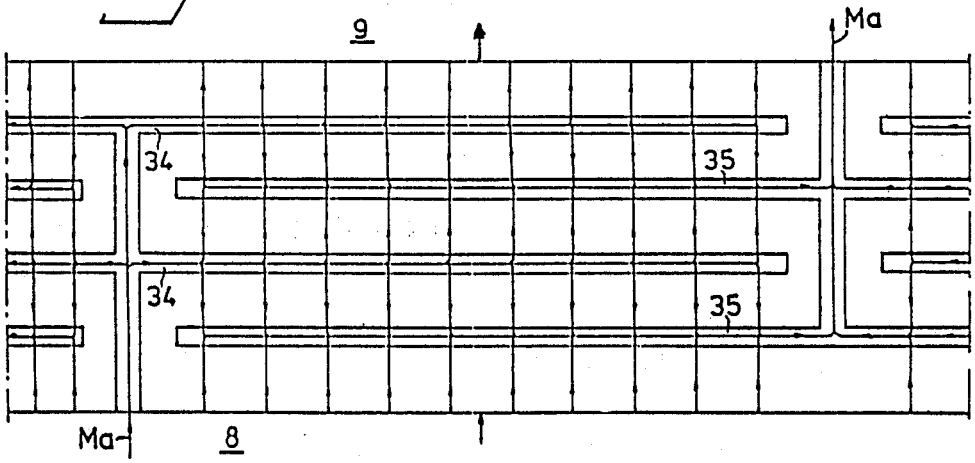

The heat-exchanger illustrated in FIGS. 6*a–c* differs from the previously described heat-exchangers, primarily in that the flow-passages 32 for the medium Ma and passages 33 for the medium Mb extend axially, while the distributing channels 34 and collecting channels 35, (illustrated in FIG. 6*c* for the medium Ma) extend substantially peripherally. The flow-passages 32,33 are defined by axially extending flanges 36 and 37 formed integrally with the cylindrical partition wall 5 on both sides thereof, and axially extending flanges 38 formed integrally with the inner surface of the outer shell wall 3 and axially extending flanges 39 formed integrally with the outer surface of the inner sleeve 20. As shown in FIG. 6*a*, the edges of respective flanges 38 and 39 are in good mechanical contact with the partition wall 5 at locations between the flanges 37 and 36 respectively of said partition wall. As with the heat-exchanger of the FIG. 5*a–c* embodiment, the different heat-exchanger elements of this embodiment also have a conical configuration, so as to provide good mechanical contact therebetween.

In the embodiment of a heat-exchanger according to the invention illustrated in FIGS. 7*a–7c*, the passage walls defining the flow-passages 40 for the medium Ma and flow-passages 41 for the medium Mb have the form of annular plates 42 and 43 respectively, which are firmly attached to the cylindrical partition wall 5, for example by brazing, welding, sintering or press-fitting, and are elastically deformed to a slightly conical shape, by being urged against the inner surface of the outer cylindrical shell 3 and the outer surface of the cylindrical sleeve 20 respectively.

A heat exchanger according to the invention can also be designed with a planar partition wall, in which case it obtains an appearance and many properties similar to those of a conventional plate heat-exchanger. The heat-transferred density obtained with a planar heat-exchanger according to the invention can be approximately equal to that of a heat exchanger according to the invention having tubular partition walls. The safety of the heat-exchanger against leakage and its pressure endurance are slightly lower, however. By applying suitable manufacturing techniques, however, it should be possible for these properties to be made comparable with or better than corresponding properties of conventional heat-exchangers. The embodiment of the heat-exchanger illustrated schematically by way of example in FIG. 8 illustrates in principle the design of one such planar heat-exchanger according to the invention. In FIG. 8 is shown the one half of the heat exchanger, intended for the one heat exchange medium Ma. The shaded surfaces of this heat-exchanger half are joined in a suitable manner with one side of a planar partition wall, e.g. by oven-brazing in vacuum, the other half of the heat exchanger intended for the other Medium Mb being joined with the other side of the partition wall. As will be understood, the various components of such a planar heat-exchanger according to the invention can also be joined together by means of draw-bolts and rigid, thick pressure-plates, the requisite seals being provided by means of pliable gaskets.

FIG. 9*a–c* illustrate an embodiment of a heat-exchanger according to the invention designed for exchanging heat between a liquid and a gas, the heat exchanger being suitable for use as a central-heating radiator. FIG. 9*a* is a schematic, perspective view of the heat exchanger, FIG. 9*b* is a vertical sectional view of the heat exchanger, and FIG. 9*c* illustrates a part of said vertical sectional view in larger scale.

In this embodiment, the heat-exchanger has a parallel-epipedic external shape and is mounted within an outer casing 46, which is open at both the top and the bottom thereof and which serves as a through-flow chamber for the gas to be heated, said gas flowing from the bottom of said casing upwardly therethrough as a result of natural draught forces. The heat exchanger comprises two identical elements 53*a* and 53*b*, each of which comprises a planar, medium-impervious partition wall 47*a* and 47*b* respectively, provided on one side thereof with horizontally projecting, mutually parallel flanges 48*a* and 48*b* respectively, and on the other side with similarly horizontal projecting parallel flanges 49*a* and 49*b*. The two heat-exchanger elements are joined together with the flanges 48*a* and 48*b* inserted between each other, so as to form therebetween slot-like liquid-flow passages 50. Slot-like gas-flow passages 51*a* and 51*b* are formed between the flanges 49*a* and 49*b* respectively. As shown, the liquid-flow passages 50 and the gas-flow passages 51*a*, 51*b* are dimensioned with respect to the mutually different properties of the two media. The liquid is introduced into the flow passages 50 from an inlet chamber 52 located at the upper end of the heat-exchanger assembly, through vertical distributing channels which extend through the flanges 48*a*, 48*b*, and is taken out from the flow passages 50 through collecting channels which extend vertically through the flanges 48*a*, 48*b* from an outlet chamber 54 located at the lower part of the heat-exchanger assembly. The gas is introduced into the flow-passages 51*a* and 51*b* respectively in a corresponding manner, through vertical distribution channels which extend upwardly through the flanges 49*a*; 49*b* from the lower end of the heat-exchanger assembly, and is taken out from the flow passages 51*a*, 51*b* through vertical collecting channels, which extend upwardly through the flanges 49*a*, 49*b*, to the upper end of the heat-exchanger assembly.

As will be understood, by applying the principles according to the invention, it is possible to produce heat exchangers of many other designs than those illustrated and described in the aforegoing. For example, a heat exchanger constructed in accordance with the invention may comprise a plurality of chambers for each of the two heat-exchanging media, these chambers being arranged alternately adjacent one another with intermediate planar partition walls, or concentrically outside each other with intermediate tubular partition walls. Such a design is the design which is likely to be most used in practice, as a result of the low passage height and therewith the subsequently larger number of passages and passage walls, necessary to achieve the volume required. In all of the described embodiments, the distributing and collecting channels are located within the actual heat-exchanger assembly, although it may be possible, or even suitable, in many cases to place these channels externally of the actual heat-exchanger assembly. In the illustrated and described embodiments it has also been assumed that both of the two heat-exchanging media have a substantially totally laminar flow. In certain fields of application, there is nothing to prevent one of the media having laminar flow while the other media is imparted a turbulent flow, in a conventional manner.

I claim:

1. A heat exchanger comprising at least two chambers (A, B) separated by means of a medium-impervious, thermally conductive partition wall (5), said chambers being through-passed by a respective one of two media (Ma, Mb) between which heat transfer is to take place, and each of said chambers being provided with at least one inlet and at least one outlet, the interior of at least one chamber being divided into a large number of flow passages (13,17) which are connected in parallel with respect to the flow of medium therethrough, the entrance ends and exit ends of the passages communicating respectively with the inlet and outlet of said chamber through distributing channels (14,18) and collecting channels (15,19) respectively, and the defining and separating walls (12,16) of said flow passages comprising a material of high thermal conductivity and being in good heat-transfer integral contact with said partition wall (5), and in which heat exchanger the flow passages (13,17) have a flow area so adapted to the medium flowing therethrough that said medium flow in said flow passages is substantially totally laminar with no central turbulent zone, characterized in that the height (h) of the flow passages (13,17) and therewith the passage walls (12,16) when seen in a direction perpendicular to the partition wall (5), has a value not exceeding 350 % of the value obtained by solving the following equation system, although not greater than that corresponding to S=H $$\left.\begin{aligned} & H^3 + H^2 (S + 1.5) - 0.5\ S^2 = 0 \\ & S = \frac{s}{2v} \sqrt{\frac{\lambda}{\lambda_M}} \\ & H = \frac{h}{v} \end{aligned}\right\} \quad (3)$$

where v=half the wall thickness of the partition wall (m)

s=the flow-passage width parallel with the partition wall (m)

h=the height of the flow passages, and therewith the passage walls, perpendicularly to the partition wall (m)

λ=the thermal conductivity of the material in the passage walls (W/mK)

$\lambda_M$=the thermal conductivity of the medium (W/mK) flowing through the flow passages, and in that the thickness (t) of the passage walls (12,16) parallel with the partition wall (5) has a value which constitutes between 30 % and 500 %, of the value obtained by the equation $$t_{opt} = 2\,h \sqrt{\frac{\lambda_M}{\lambda}} \quad (2)$$

where t=the passage wall thickness (m).

2. A heat exchanger according to claim 1, characterized in that the width (s) of the flow passages (13,17) in a direction parallel to the partition wall (5) is smaller than 1.5 mm.

3. A heat exchanger according to claim 1, characterized in that the passage walls (12,16) defining the flow passages (13,17) are provided with a slot-like interruption (25) at at least one location along the length of said passages, so that at this location the velocity distribution profile of the medium flowing through said passage, as seen transversely of the passage at right angles to the passage walls, is re-established to a substantially linear configuration, and so that the heat-transfer path in the passage walls in the longitudinal direction of the flow passages is interrupted.

4. A heat exchanger according to claim 3, characterized in that said heat exchanger comprises a plurality of mutually parallel flow passages (23), and in that said slot-like interruptions in the passage walls (24) defining and separating the flow passages are located in register with each other, so that together they form a slot (25) extending transversely to said flow passages. (FIGS. 3*a*, 3*b*).

5. A heat exchanger according to claim 4, characterized in that the flow passages (23) on one side of said transverse slot (25) are displaced laterally in the direction of extension of the slot relative to the flow passages (23) on the other side of the slot through a distance corresponding to half the pitch between two adjacent flow passages (FIG. 3*a*).

6. A heat exchanger according to claim 4, characterized in that said transverse slot (25) communicates at one end thereof with the medium inlet and at the other end thereof with the medium outlet, such that medium in said slot flows transversely to the flow direction in the flow passages (23), whereby not all of the medium flow exiting from a given flow passage (23) on one side of the slot (25) will flow into the oppositely located flow passage (23) on the other side of the slot, but that part of said medium flow will pass into an adjacent flow passage. (FIG. 3*b*).

7. A heat exchanger according to claim 3, characterized in that the walls (12,16) of the flow passages (13,17) have at least two slot-like interruptions (25) arranged at locations uniformly spaced along the length of the said flow passages.

8. A heat exchanger according to claim 1, characterized in that the passage walls (12,16) are formed integrally with the partition wall (5) (FIG. 4).

9. A heat exchanger according to claim 1, characterized in that the passage walls (42,43) are formed by elements which are separate from the partition wall (5) and which are arranged so that the edges of said elements facing said partition wall are in good mechanical and thermal-conductive contact with said partition wall (FIG. 7).

10. A heat exchanger according to claim 1, characterized in that the mutually parallel passage walls (12,30,16,31) are alternately and respectively formed integrally with the partition wall (5), and by elements (3031,) separate from said partition wall, the edges of said elements facing the partition wall being in good mechanical and heat-conductive contact therewith (FIG. 5).

11. A heat exchanger according to claim 1, characterized in that the two chambers (A, B) for respective medium flows are of annular configuration and arranged concentrically on both sides of the substantially cylindrical partition wall (5), and in that the medium inlets and outlets are arranged at the axial ends of the chambers (FIG. 4).

12. A heat exchanger according to claim 11, characterized in that the flow passages (13,17) extend substantially peripherally through the respective annular chambers (A, B), while the distributing and collecting channels (14,15,18,19) extend substantially axially (FIG. 4).

13. A heat exchanger according to claim 11, characterized in the flow passages (32,33) extend substantially axially through the respective annular chambers (A, B) the distributing and collecting channels (34,35) extending substantially peripherally (FIG. 6).

14. A heat exchanger according to claim 11, characterized in that the cylindrical partition wall (5) is sealingly mounted at both ends thereof onto opposing end walls (1,2) at the axial ends of the annular concentrical chambers (A, B), the outer chamber (A) being defined radially outwardly by an external cylindrical shell (3), the two ends of which are sealingly connected to the two end walls (1,2), and the inner chamber (B) being radially inwardly defined by an internal cylindrical sleeve (20) (FIG. 4).

15. A heat exchanger according to claim 14, characterized in that the passage walls (30,31) separate from the partition wall (5) are formed integrally with the outer shell (3) and the inner sleeve (20) respectively (FIG. 5).

16. A heat exchanger according to claim 14, characterized in that the heat-exchanger components are held together by a bolt (4) firmly mounted in the two end walls (1,2) and extending through said sleeve (20) internally of the heat exchanger.

17. A heat exchanger according to claim 1, characterized in that the two chambers through which respective media flow have a substantially planeparallel configuration and are arranged on mutually opposite sides of the substantially planar partition wall.

18. A heat exchanger according to claim 1 wherein said thickness of the passage walls parallel with the partition wall has a value further limited between 100% to 350% of the value obtained by said equation of $t_{opt}$.

19. A heat exchanger according to claim 1, characterized in that the width (s) of the flow passages (13, 17) in a direction parallel to the partition wall (5) is smaller than 1.0 mm.

* * * * *